United States Patent [19]

Rapp

[11] Patent Number: 4,921,248

[45] Date of Patent: May 1, 1990

[54] BASKETBALL RIM ASSEMBLY

[76] Inventor: Richard L. Rapp, 205 Rosewood Dr., Lima, Ohio 45805

[21] Appl. No.: 417,027

[22] Filed: Oct. 4, 1989

[51] Int. Cl.[5] ..... A63B 63/08

[52] U.S. Cl. ..... 273/1.5 R; 81/15.9; 81/486; 248/221.3; 248/222.1; 294/19.1

[58] Field of Search ..... 273/1.5 R, 1.5 A; 248/221.3, 222.1; 81/15.9, 486; 294/19.1

[56] References Cited

U.S. PATENT DOCUMENTS

| | | | |
|---|---|---|---|
| 1,246,749 | 11/1917 | Joiner | 248/222.1 X |
| 1,252,207 | 1/1918 | Walker | 248/221.3 |
| 1,522,957 | 1/1925 | Kennedy | 273/1.5 R |
| 2,091,378 | 8/1937 | Simpson et al. | 248/221.3 |
| 3,036,803 | 5/1962 | Fiebelkorn | 248/221.3 |
| 3,764,175 | 10/1973 | Yavitch | 81/15.9 X |
| 4,613,135 | 9/1986 | Rush | 273/1.5 R |
| 4,726,263 | 2/1988 | Lake | 81/15.9 |
| 4,798,381 | 1/1989 | Dadbeh | 273/1.5 R |

*Primary Examiner*—Paul E. Shapiro

*Attorney, Agent, or Firm*—Emch, Schaffer, Schaub & Porcello Co.

[57] ABSTRACT

A basketball rim assembly for removably mounting a rim to a backboard is disclosed. The rim assembly includes a base defining a locking hole mounted on the backboard. A support member mounts the rim and is removably locked to the base by a locking pin which is received by the locking hole. A cam socket which is mounted on a handle engages one end of the locking pin to lock and unlock the pin relative to the locking hole.

9 Claims, 3 Drawing Sheets

BASKETBALL RIM ASSEMBLY

BACKGROUND OF THE INVENTION

Basketball is a common recreational sport in many parts of the United States and in other countries. In many facilities, commonly on outside school playgrounds and in muncipal playgrounds, unsupervised play often results in vandalism or damage to basketball backboards and rims. In some locations, the situation is severe enough that the backboards and rims are simply removed from the outdoor facilities.

The present invention is directed to a basketball rim assembly for use in removably mounting a basketball rim to a basketball backboard. Removable basketball rims are known in the prior art. As early as 1925, a removable rim which was mounted on the side of a building was disclosed in Kennedy U.S. Pat. No. 1,552,957.

Another removable rim is shown in Rush U.S. Pat. No. 4,613,135.

Prior art removable rims did not sufficiently control the vertical position of the rim relative to the ground. In the prior art removable rims disclosed in the above patents, there is not a secure device which gives a precise vertical position. The Kennedy removable rim has no vertical locking provision. The Rush removable rim includes a slotted opening which receives a lug and is secured by a wing nut.

Furthermore, the prior art removable rim devices required the person who is removing the rim or replacing the rim to climb a ladder or by some other means reach the level of the rim to either remove or replace the rim.

SUMMARY OF THE INVENTION

The present invention is directed to an improved basketball rim assembly for removably mounting a basketball rim to a basketball backboard. The basketball rim assembly of the present invention allows a playground superintendent or other person to stand on the ground and either remove or replace the basketball rim. This allows such a person to remove and replace several rims at a facility both quickly and safely.

The basketball rim assembly, according to the present invention, includes a base member for mounting on a basketball backboard. A support member having generally perpendicular extending legs has one leg removably mounted on the base member while the second leg mounts the basketball rim. A post depends from the second leg and receives a lock pin having ends extending on opposite sides of the post. One end is removably positioned in a locking hole in the base while the other end is receivable in a camming slot of an elongated handle. The camming slot is defined in a cam socket which is mounted adjacent the upper end of the operating handle.

When the person who desires to remove or reinstall the basketball rim rotates the handle, movement of the end of the lock pin along the camming slot engages and disengages the other end of the lock pin from the locking hole.

BRIEF DESCRIPTION OF THE DRAWINGS

FIG. 2 shows a downward movement of the first leg into the base member;

FIG. 3 shows a similar view after the rim is in its correct vertical position and prior to rotation of the handle;

FIG. 4 shows a similar view after the handle has been rotated to release the lock pin into the locking hole;

FIG. 5 is a similar view showing the handle and cam socket being removed from the installed basketball rim;

DESCRIPTION OF THE PREFERRED EMBODIMENT

Figure 1:
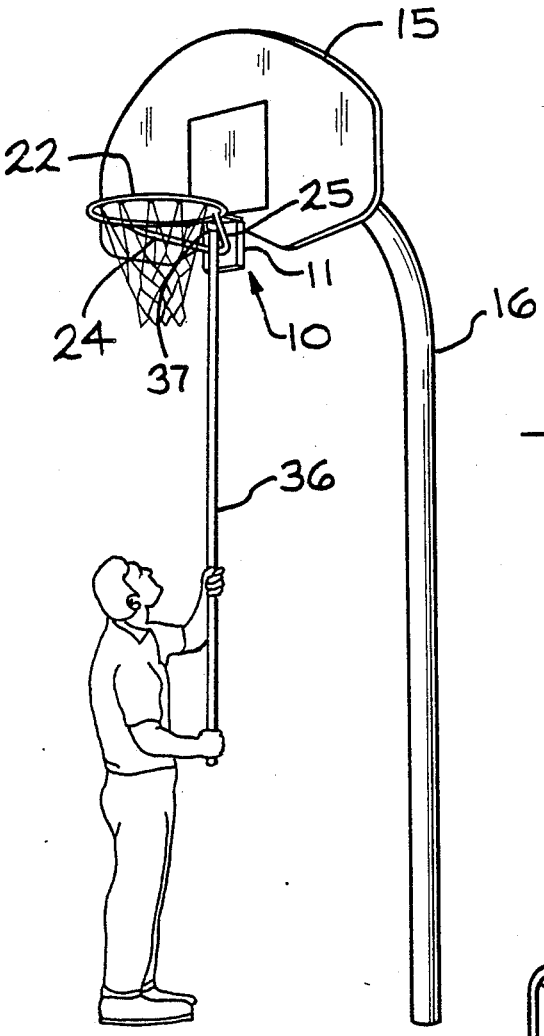
FIG. 1 is a perspective view of a person using a basketball rim assembly according to the present invention.

A basketball rim assembly, according to the present invention, is generally indicated by the reference number 10 in FIG. 1. The basketball rim assembly 10 includes a base member 11 having opposed guide channels 12 and 13 and a locking hole 14. The base member 11 is secured to a backboard 15 which is supported by a post 16.

The basketball rim assembly 10 also includes a support member 18. In the present embodiment, the support member 18 is an angle member having perpendicularly extending first and second legs, 19–20. A basketball rim 22 is welded or otherwise secured to the free end of the second leg 20. A brace assembly 23 is welded or otherwise secured to the first leg 19 and includes struts 24 and 25 which extend upwardly and are connected to the basketball rim 22.

Figure 6:
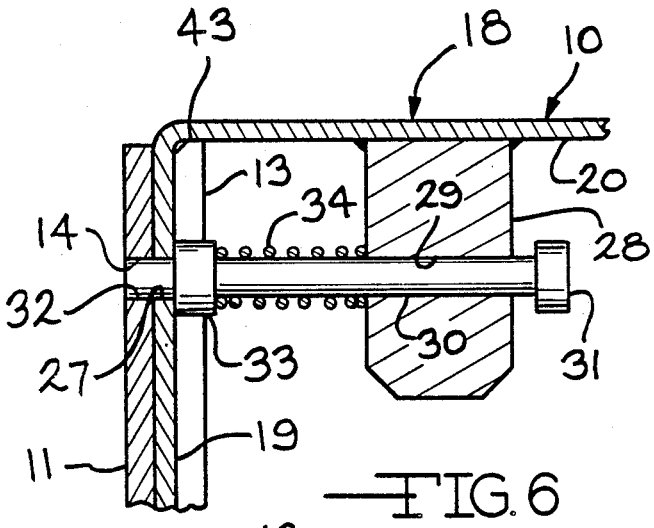
FIG. 6 is a cross-sectional view of the basketball rim assembly when in the FIG. 5 position.

The first leg 19 of the support member 18 defines a lock hole 27. In the present embodiment, when the basketball rim assembly 10 is in its installed position, as shown in FIG. 6, the lock hole 27 of the first leg 19 is aligned with the locking hole 14 of the base member 11. A post 28 depends from the second leg 20 of the support member 18 and defines an opening 29 which is parallel to the second leg 20. A lock pin 30 is slideably positioned within the opening 29 and has a first end 31 and a second end 32. In the present embodiment the first end 31 comprises an enlarged cam end. The second end or lock end 32 extends outwardly from the post 28 in an opposed relationship to the outwardly extending first end 31. The lock end 32 ends through the lock hole 27 and is engageable in the locking hole 14 of the base member 11. A stop member 33 which is integral with or fixed to the lock pin 30 is located adjacent the lock end 32. A spring 34 surrounds the lock pin 30 and extends between the post 28 and the stop member 33. The spring 34 biases the stop member 33 against the second leg 19 to securely engage the lock end 32 of the lock pin 30 in its fully seated position, as shown in FIG. 6.

Figure 5:
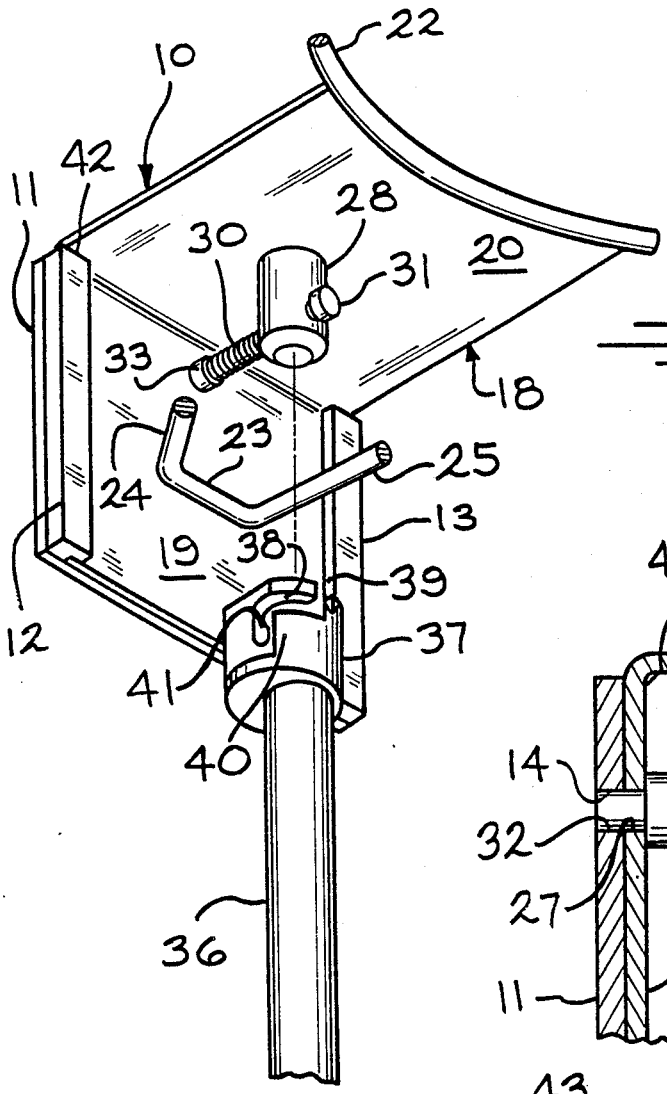

The basketball rim assembly 10 also includes a cam assembly comprising an elongated handle 36 having a cam socket 37 mounted adjacent its upper end. As best shown in FIG. 5, the cam socket 37 defines a camming slot 38 having a vertical open portion 39, a transverse portion 40 and a vertically downward portion 41.

Figure 7:
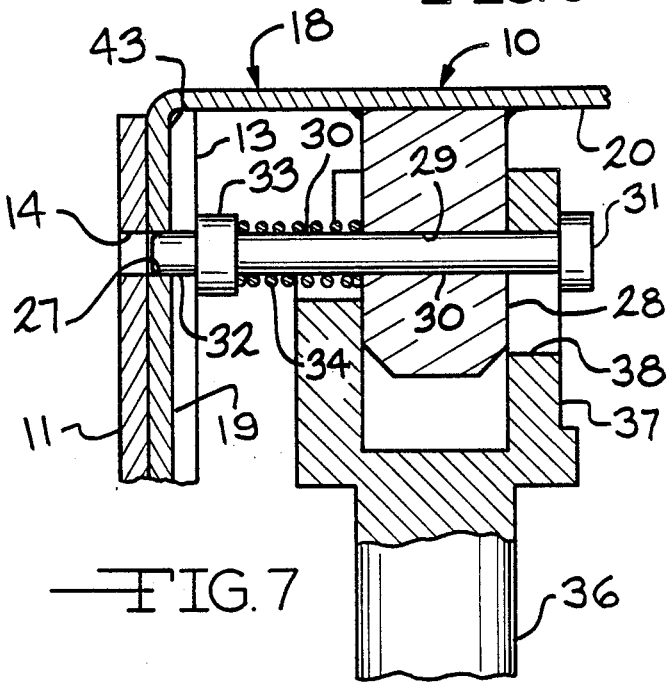
FIG. 7 is a cross-sectional view, similar to FIG. 6, showing the basketball rim assembly when the locking pin has been moved from the locking hole.

Referring to FIGS. 5 and 6, when it is desired to remove the basketball rim, the operator stands on the ground and by using the rod 36 inserts the first end or cam end 31 into the camming slot 38 defined in the cam socket 37. The position of the stop member 33 against the first leg 19 of the support member 18 insures that the cam end 31 of the lock pin is spaced away from the post 28 so that it may be received in the cam slot 37. Referring to FIGS. 5, 6 and 7, after the cam end 31 is in the camming slot 38, the handle 36 is rotated in a clockwise direction, when viewed from below, to move the cam end 31 along the cam slot 38. When the cam end 31 reaches its bottom position within the vertically downward portion 41 of the camming slot 38, the cam action of the camming slot 38 has moved the lock end 32 outwardly from the locking hole 14 of the base member 11. When in this position, the person standing on the ground simply moves the handle 36 upwardly until the base member 11 is moved above the guide channels 12 and 13 (see FIG. 2) where the rim 22 may be removed and stored for future use.

To reinstall the basketball rim 22 at a later date, the person simply reverses the procedure as is illustrated in the sequential steps of FIGS. 2–5. The handle 36 having its cam socket 37 is engaged with the cam end 31 of the lock pin 30 when the unit is on the ground. Therefore, as shown in FIG. 2, the cam end 31 is already in the vertical downward position 41 and the stop member 33 has been moved closer to the cam socket 37 against the bias of the spring 34.

Figure 2:
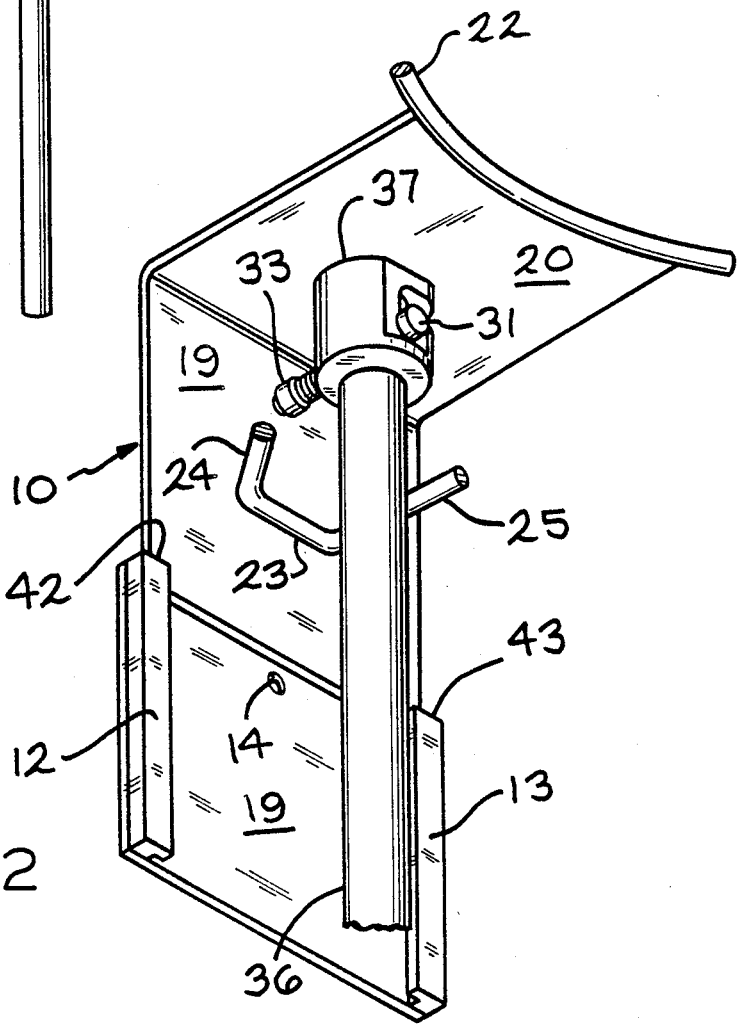
FIGS. 2–5 are fragmentary perspective views showing the sequential reinstallation of a basketball rim, using the basketball rim assembly shown in FIG. 1.

As shown in FIG. 2, the first leg 19 of the support member 18 is inserted in the guide channels 12 and 13. The upper ends of the guide channels 12 and 13 define locator surfaces 42 and 43. The locator surfaces 42 and 43 together with the locking hole 14 defined in the base member 11 exactly position the second leg 20 and its attached backetball rim 22 in a predetermined correct vertical position when in its fully seated and installed position.

Figure 3:
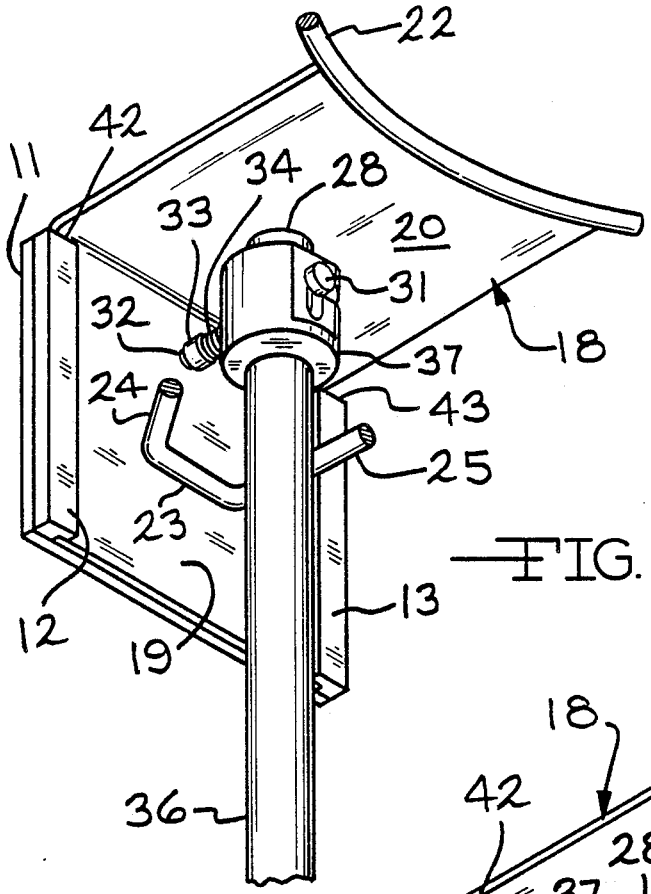
Figure 4:
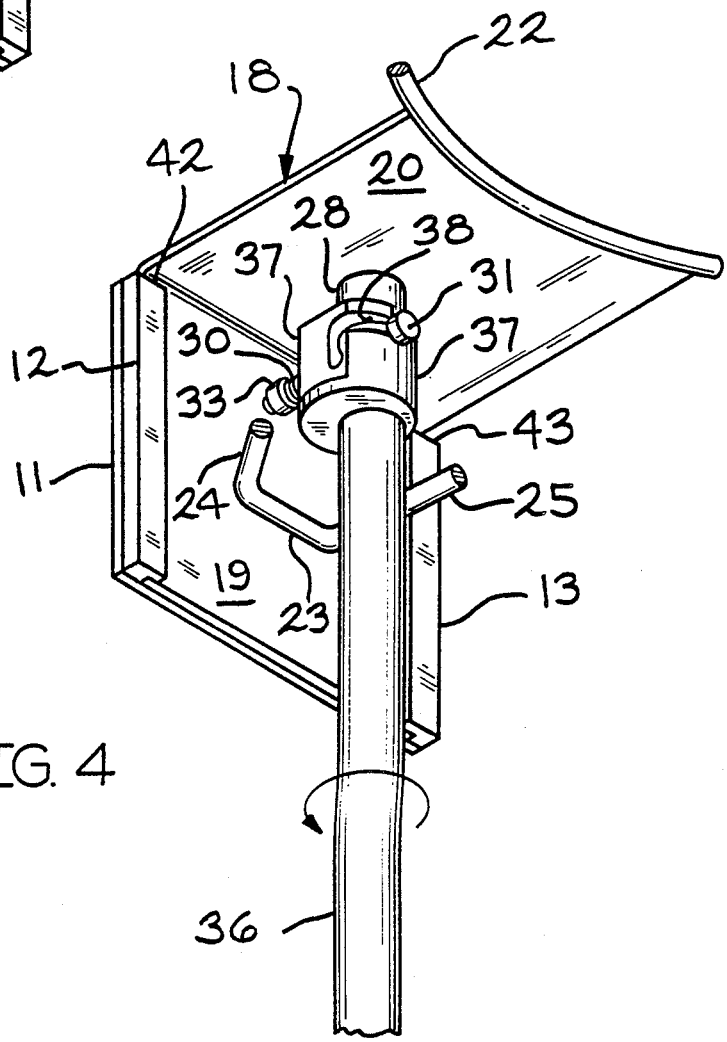

Referring to FIGS. 3 and 4, the first leg 19 is moved downwardly in the guide channels 12 and 13 until the locator surfaces 42 and 43 are engaged by the second leg 20 and the lock end 32 of the locking pin 30 correctly aligned with the locking hole 14 of the base member 11. Counterclockwise rotation of the handle 36, as viewed from below, urges the cam end 31 along the cam socket 37. The biasing of the spring 34 against the stop member 33 urges the lock end 32 of the lock pin 30 into its completely seated position, as shown in FIG. 6. Referring to FIG. 5, downward movement of the handle 36 removes the cam end 31 of the lock pin 30 from the vertical open portion 39 of the camming slot 38. When in this position, the handle 36 may be removed for future use.

Many changes and revisions may be made to the preferred embodiment of the above disclosed invention without departing from the scope of the following claims.

I claim:

1. A basketball rim assembly for use in removably mounting a basketball rim to a basketball backboard, said rim assembly including a base member for mounting on such basketball backboard, said base member defining a locking hole, a support member having first and second legs, said first leg being removably positioned adjacent said base member, said second leg extending outwardly from said first leg for mounting such basketball rim, a post depending from said second leg, said post defining an opening, a lock pin positioned within said post opening, said lock pin having first and second ends, said first and second ends extending outwardly from said post in opposed relationship, said second end being engagable in said locking hole of said base member, said rim assembly including a cam assembly comprising a handle having a cam socket mounted adjacent one end, said cam socket defining a camming slot for receiving said first end of said lock pin, whereby rotation of said cam socket and movement of said first end of said lock pin along said camming slot engages or disengages said second end of said lock pin with respect to said locking hole of said base member.

2. A basketball rim assembly, according to claim 1, including a spring for urging said lock pin toward said locking hole.

3. A basketball rim assembly, according to claim 2, including a stop member spaced from said second end of said lock pin, said spring comprising a coil spring surrounding said lock pin and positioned between said stop member and said post.

4. A basketball rim assembly, according to claim 1, wherein said first and second legs of said support member are perpendicular to one another.

5. A basketball rim assembly, according to claim 4, wherein guide channels are mounted on the opposed sides of said base member, said guide channels receiving said first leg of said support member.

6. A basketball rim assembly, according to claim 5, wherein said guide channels define locator surfaces at their upper ends, said locator surfaces engaging said second leg of said support member when such basketball rim is in a predetermined vertical position.

7. A basketball rim assembly, according to claim 1, wherein first end of said lock pin comprising an enlarged cam end, said cam end being received by said camming slot of said cam socket.

8. A basketball rim assembly according to claim 7, wherein said camming slot includes a vertically open portion, a transverse portion and a vertically downward portion.

9. A basketball rim assembly for use in removably mounting a basketball rim to a basketball backboard, said rim assembly including a base member for mounting on such basketball backboard, said base member defining a locking hole, a pair of opposed guide channels mounted on said base member, said guide channels defining a locator surface adjacent their upper ends, a support member having first and second perpendicularly extending legs, said first leg being received by said guide channels of said base member, said second leg mounting such basketball rim, said second leg of said support member engaging said locator surface when said basketball rim is in a predetermined vertical position, a post depending from said second leg, said post defining a transverse opening aligned with said locking hole of said base member, a lock pin having first and second ends positioned for movement with said transverse opening, said first end comprising an enlarged cam end, said second end of said lock pin comprising a lock end received by said locking hole of said base member, a stop member on said lock pin adjacent said second end, a spring surrounding said lock pin positioned between said post and said stop member, said spring urging said second end toward said locking hole, said rim assembly including a cam assembly comprising an elongated handle having a cam socket mounted adjacent one end, said cam socket defining a camming slot for receiving said first end of said lock pin, whereby rotation of said cam socket and movement of said first end of said lock pin along said camming slot engages or disengages said second end of said lock pin with respect to said locking hole of said base member.

* * * * *